US008696402B2

(12) United States Patent
Robins et al.

(10) Patent No.: US 8,696,402 B2
(45) Date of Patent: Apr. 15, 2014

(54) WINDUP TOY VEHICLE

(75) Inventors: Canyon Robins, McKinleyville, CA (US); Duncan G. Robins, McKinleyville, CA (US)

(73) Assignee: Slotter, LLC, McKinleyville, CA (US)

( * ) Notice: Subject to any disclaimer, the term of this patent is extended or adjusted under 35 U.S.C. 154(b) by 292 days.

(21) Appl. No.: 13/115,002

(22) Filed: May 24, 2011

(65) Prior Publication Data

US 2012/0302130 A1 Nov. 29, 2012

(51) Int. Cl.
*A63H 29/18* (2006.01)

(52) U.S. Cl.
USPC ..... 446/459; 446/461; 446/464

(58) Field of Classification Search
USPC ..... 446/457, 459, 461, 464
See application file for complete search history.

(56) References Cited

U.S. PATENT DOCUMENTS

| | | | | |
|---|---|---|---|---|
| 108,224 | A | | 10/1870 | Wickham |
| 1,203,438 | A | | 10/1916 | Webster |
| 1,599,101 | A | | 6/1923 | Savage |
| 1,546,431 | A | | 10/1924 | Brandt |
| 1,775,914 | A | | 1/1927 | Parkhurst |
| 1,765,435 | A | | 6/1928 | McBride |
| 1,779,349 | A | | 2/1930 | Whatley |
| 1,962,870 | A | | 4/1933 | Herbst |
| 2,306,898 | A | | 1/1942 | Palmer |
| 2,351,504 | A | | 1/1943 | Guillow |
| 2,543,516 | A | | 8/1948 | Walker |
| 2,546,223 | A | | 8/1949 | Jenkins |
| 2,741,873 | A | | 11/1951 | Erickson |
| 2,643,484 | A | * | 6/1953 | Poulin ..... 446/464 |
| 2,749,660 | A | * | 6/1956 | Zimentstark ..... 446/459 |
| 2,766,849 | A | * | 10/1956 | Rudiger ..... 185/37 |
| 3,474,566 | A | * | 10/1969 | Tomeo, Jr. et al. ..... 446/459 |
| 3,535,947 | A | * | 10/1970 | Kupperman et al. ..... 74/414 |
| 3,583,096 | A | * | 6/1971 | Stubbmann ..... 446/459 |
| 3,611,631 | A | * | 10/1971 | Folson ..... 446/459 |
| 3,645,039 | A | | 2/1972 | Bross |
| 3,720,016 | A | * | 3/1973 | Kupperman et al. ..... 446/459 |
| 3,769,746 | A | * | 11/1973 | Prodger et al. ..... 446/459 |
| 3,772,822 | A | * | 11/1973 | Kupperman et al. ..... 446/459 |
| 3,938,278 | A | * | 2/1976 | Nakamori ..... 446/461 |
| 3,981,098 | A | * | 9/1976 | Darda ..... 446/464 |
| 4,121,376 | A | * | 10/1978 | Lemelson ..... 446/176 |

(Continued)

OTHER PUBLICATIONS

Folk Toys, Fun Science Gallery, http://www.funsci.com/fun3_en/toys/toys.html, Oct. 1997, 10 pages.

(Continued)

*Primary Examiner* — Gene Kim
*Assistant Examiner* — Joseph B Baldori
(74) *Attorney, Agent, or Firm* — Kolisch Hartwell, P.C.

(57) ABSTRACT

A windup toy vehicle is provided. In some embodiments, the vehicle may include a body and a wheel assembly that is connected to the body and that defines an axis about which the wheel assembly spins. The vehicle also may include a spring extending at least generally along the axis and having a first end and a second end that are respectively fixed and pivotable with respect to the wheel assembly. An arm may be coupled to the spring at the second end such that the arm and the second end pivot as a unit. The vehicle further may include a stop supported by the body and configured to block the arm from spinning with respect to the body.

14 Claims, 4 Drawing Sheets

(56) References Cited

U.S. PATENT DOCUMENTS

| | | | | | |
|---|---|---|---|---|---|
| 4,276,716 | A | * | 7/1981 | Mabuchi | 446/459 |
| 4,406,084 | A | * | 9/1983 | D'Andrade | 446/459 |
| 4,416,083 | A | * | 11/1983 | Kubiatowicz | 446/459 |
| 4,752,271 | A | | 6/1988 | Reilly et al. | |
| 5,433,641 | A | | 7/1995 | Rudell et al. | |
| 5,562,522 | A | * | 10/1996 | Richno | 446/444 |
| 5,882,240 | A | | 3/1999 | Larsen | |
| 6,066,026 | A | * | 5/2000 | Bart et al. | 446/460 |
| 6,722,940 | B1 | * | 4/2004 | Weikel | 446/464 |

OTHER PUBLICATIONS

Baley Anne, How to make a spool car, http://www.ehow.com/how_6146175_make-spool-car.html, May 5, 2010, 3 pages.

The Rubber Band, cars, planes and boats and how they are made, http://www.the-rubber-band.com/vehicles.php, 2 pages.

* cited by examiner

WINDUP TOY VEHICLE

INTRODUCTION

For decades, parents and children created inexpensive toys from readily available materials. One such classic was a windup toy made from a spool (after all the thread had been used), a rubber band, and a matchstick broken into two pieces (a longer stick and a shorter stick). The windup toy was created by stringing a rubber band through the center of the spool and hooking one end (a first end) of the rubber band over the shorter stick and the other end (a second end) over the longer stick. The shorter stick fixed the first end of the rubber band. The shorter stick was shorter than the diameter of the spool, and was affixed to the spool such that it could not move relative to the spool. The longer stick was typically up to twice as long as the diameter of the spool, and was attached such that the longer stick and the second end of the rubber band could spin relative to the spool.

The windup toy was "charged" by twisting the rubber band, which acted as a spring. Twisting was accomplished by spinning the longer stick about an axis created by the central channel of the spool. When the rubber band was sufficiently loaded, the toy could be placed on the ground (or other flat surface) and released, allowing the rubber band to release stored energy by untwisting. The spool was driven to roll forward as the rubber band untwisted, because the longer stick jammed itself against the ground, creating a fixed point about which the spool could spin.

Unfortunately, it is rare now to see children playing with this homemade windup toy, in part because mass-produced, plastic windup toys offer an inexpensive and effortless substitute. Another factor may be the near obsolescence of the primary components (match sticks and spools). The final blow would have to be the inability of this homemade toy to compete with the capabilities of newer windup toys due to its simplistic, limiting design.

This classic windup toy was limited in many ways. The length and diameter of the spool's central channel restricted the size of rubber band that could be used. In most cases, the rubber band had to be short and narrow, which limited the amount of energy that could be stored, the duration of unwinding, and the distance the toy could travel. Also, there was typically a lot of friction between the spinning spool and the longer stick, reducing the efficiency of the rubber-band motor. The longer stick also produced considerable friction as it dragged along the ground, acting like a brake to slow the toy and like a crude rudder to force the toy to veer from a straight path. Further, the efficiency of the toy was limited by its low mass, which did not generate sufficient purchase for the spool to roll on the ground without slippage.

Windup toy vehicles with wheels rely on a different type of spring mechanism. With the higher frictional forces at work, toy developers needed a motor that could unleash greater power over a shorter duration and be more adaptable. Toy developers chose to employ drive trains that incorporated a coiled or stretched band of rubber or steel (rather than a twisted one) that had a portion of the band (or a string attached to the band) that wrapped around a rear axle. The vehicle was ultimately powered by the unwrapping of the band or string from the axle as the spring relaxed, which caused one or more wheels to turn. In more modern toy vehicles, a wound steel band and gears typically drive vehicle travel. This form of spring mechanism is ideal for making small, inexpensive toy vehicles if volumes are high because the tooling costs are significant. However, for lower volume kit cars, a design requiring lower capital expenditure is required.

SUMMARY

The present disclosure provides a windup toy vehicle. In some embodiments, the vehicle may include a body and a wheel assembly that is connected to the body and that defines an axis about which the wheel assembly spins. The vehicle also may include a spring extending at least generally along the axis and having a first end and a second end that are respectively fixed and pivotable with respect to the wheel assembly. An arm may be coupled to the spring at the second end such that the arm and the second end pivot as a unit. The vehicle further may include a stop supported by the body and configured to block the arm from spinning with respect to the body.

DETAILED DESCRIPTION

The present disclosure provides a windup toy vehicle. In some embodiments, the vehicle may include a body and a wheel assembly that is connected to the body and that defines an axis about which the wheel assembly spins. The vehicle also may include a spring extending at least generally along the axis and having a first end and a second end that are respectively fixed and pivotable with respect to the wheel assembly. An arm may be coupled to the spring at the second end such that the arm and the second end pivot as a unit. The vehicle further may include a stop supported by the body and configured to block the arm from spinning with respect to the body. The spring may be twistable, and untwisting of the spring, with the arm blocked from spinning by the stop, may drive the wheel assembly to spin with respect to the body.

I. OVERVIEW OF AN EXEMPLARY TOY VEHICLE

Figure 1:
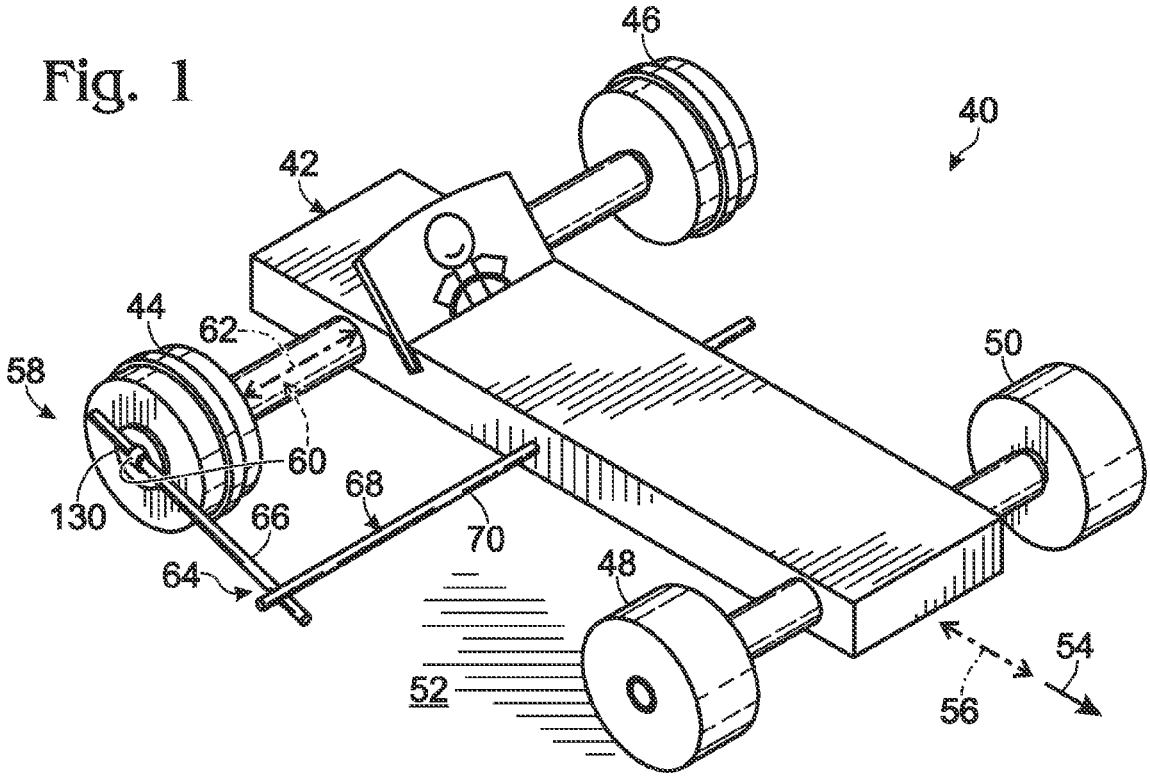
FIG. 1 is an isometric view of an exemplary toy vehicle constructed according to aspects of the present disclosure, with an arm of the vehicle's drive train engaged with a stop that prevents the arm from spinning.

FIG. 1 shows an exemplary toy vehicle 40 constructed according to aspects of the present disclosure. Vehicle 40 includes a body 42 and a plurality of wheels 44-50 rotatably connected to the body, to permit the wheels to spin with respect to the body. The wheels are arranged to roll collectively on a generally horizontal play surface 52 (e.g., the ground, a floor, a table, or the like), with the body supported above the play surface by the wheels and propelled in a direction of travel 54 along a travel axis 56 of the vehicle. Generally, the wheels may be capable of spinning in both rotational directions, to permit the vehicle to travel in each opposing direction defined by axis 56. Accordingly, forward and reverse directions of travel for the vehicle may be designated arbitrarily and/or defined by the structure of body 42, among others.

At least one of the wheels of vehicle 40 is a driven wheel. In the depicted embodiment, both rear wheels 44, 46 are part of a windup drive train 58 that stores energy in a spring 60 and serves as a motor for the vehicle. The energy may be stored by twisting the spring, in either rotational direction, at least generally about a winding axis 62 (also termed a twist axis) defined by the spring (e.g., defined generally by the long axis of the spring) and/or defined by a channel of the drive train (see below). The energy then may be released as the spring untwists, to drive rotation of the driven wheel(s). In other embodiments, at least one front or intermediate wheel may be a driven wheel.

Vehicle 40 may include a clutch assembly 64 that regulates actuation of the drive train. Clutch assembly 64 may include an arm 66 forming part of drive train 58. The arm may extend transversely from winding axis 62, and farther than the radius of the wheel, and may be pivotable about the winding axis. The arm may or may not be used as a crank that is engaged manually, to spin the arm, which winds up the spring. The clutch assembly also may be equipped with a stop 68, which may be supported by and connected movably to body 42. For example, the stop may be slidable (e.g., as in the depicted embodiment (compare FIGS. 1 and 2)), bendable, pivotable, or a combination thereof. In some examples, stop 68 may be fixed to body 42, such that the position of the stop is not adjustable with respect to the body.

Figure 2:
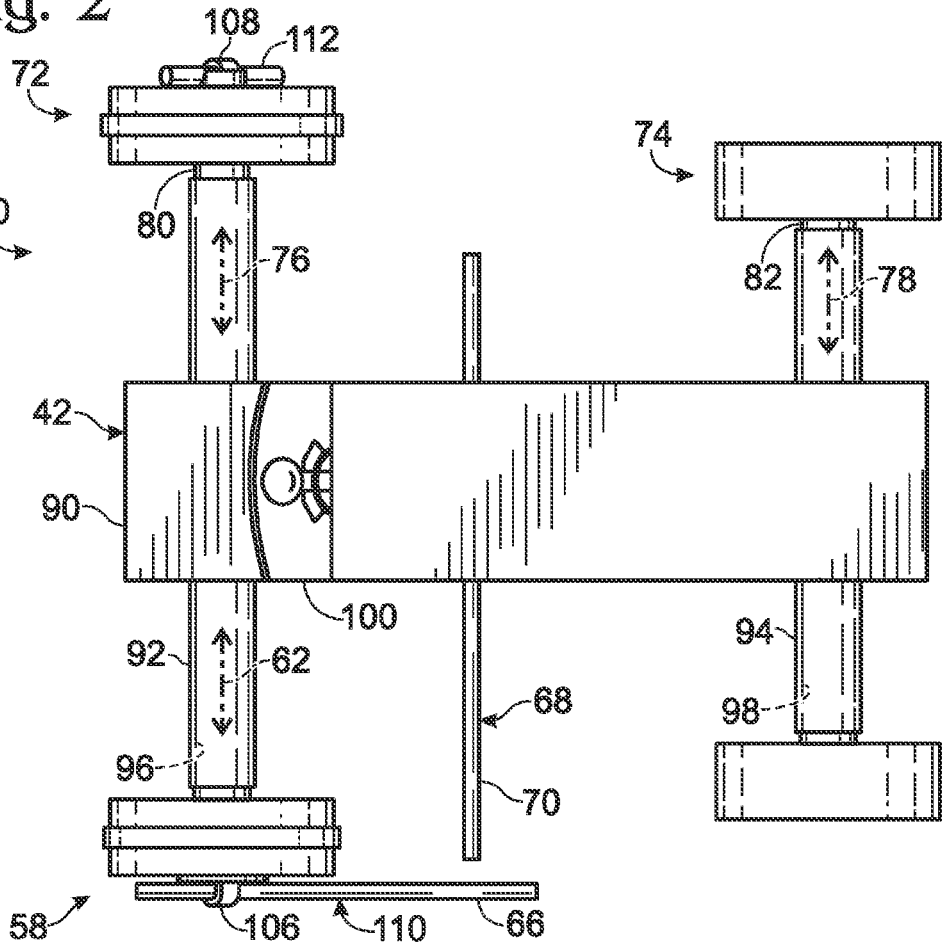
FIG. 2 is a plan view of the toy vehicle of FIG. 1, with the stop in a retracted configuration that allows the arm to spin.

The clutch assembly may be adjustable between an engaged configuration (also termed a deployed configuration) and a disengaged configuration (also termed a retracted configuration). The engaged configuration (e.g., as shown in FIG. 1) couples (a) twisting/untwisting of the spring to (b) rotation of the driven wheel(s) with respect to body 42. In the engaged configuration, arm 66 may be in engagement with stop 68, to prevent arm 66 from spinning. The disengaged configuration (e.g., as shown in FIG. 2) uncouples (a) twisting/untwisting of the spring from (b) rotation of the driven wheel(s) with respect to body 42. In the disengaged configuration, arm 66 may be out of engagement with stop 68 and, generally, spaced from the stop. Further aspects of clutch assemblies, arms, and stops are described below.

Clutch assembly 64 incorporates an engagement point (on stop 68) that is supported by the body of a vehicle and that is capable of blocking rotation of arm 66. The engagement point may be provided by a rod 70 projecting from the vehicle body. However, this engagement point could be of any design or material that allows for engagement of arm 66 while remaining clear of spinning wheel 44 (e.g., see Section II). In the illustrated design, the engagement point is designed to be movable from an engaging position, allowing the drive train to move the vehicle, to a disengaged position, which in this design makes the winding of the spring with arm 66 easier. Because arm 66 engages stop 68 on the vehicle, rather than contacting the play surface, there is less friction, making the drive train more efficient. Additionally, without the arm dragging along the play surface, acting as a "rudder," the vehicle is more likely to travel in a straight line. Additional advantages of the engagement point include the ability to shorten the member that provides arm 66 to a length just slightly longer than the radius of the adjacent wheel. Also, the drive train can now operate independently of the play surface, allowing the vehicle to travel on uneven surfaces or even jump obstacles.

The toy vehicle may be a miniature representation of a full-size vehicle. For example, the toy vehicle may represent a land vehicle (e.g., a car, bus, van, truck, train, or the like), an aircraft (e.g., an airplane, a jet, etc.), a watercraft (e.g., a boat, submarine, etc.), or the like. If an aircraft, the vehicle's driven wheels(s) may be replaced by a propeller, or the aircraft may be a wheeled vehicle configured for land travel only. If a watercraft, the driven wheel(s) may be replaced by a paddle wheel or propeller.

Figure 3:
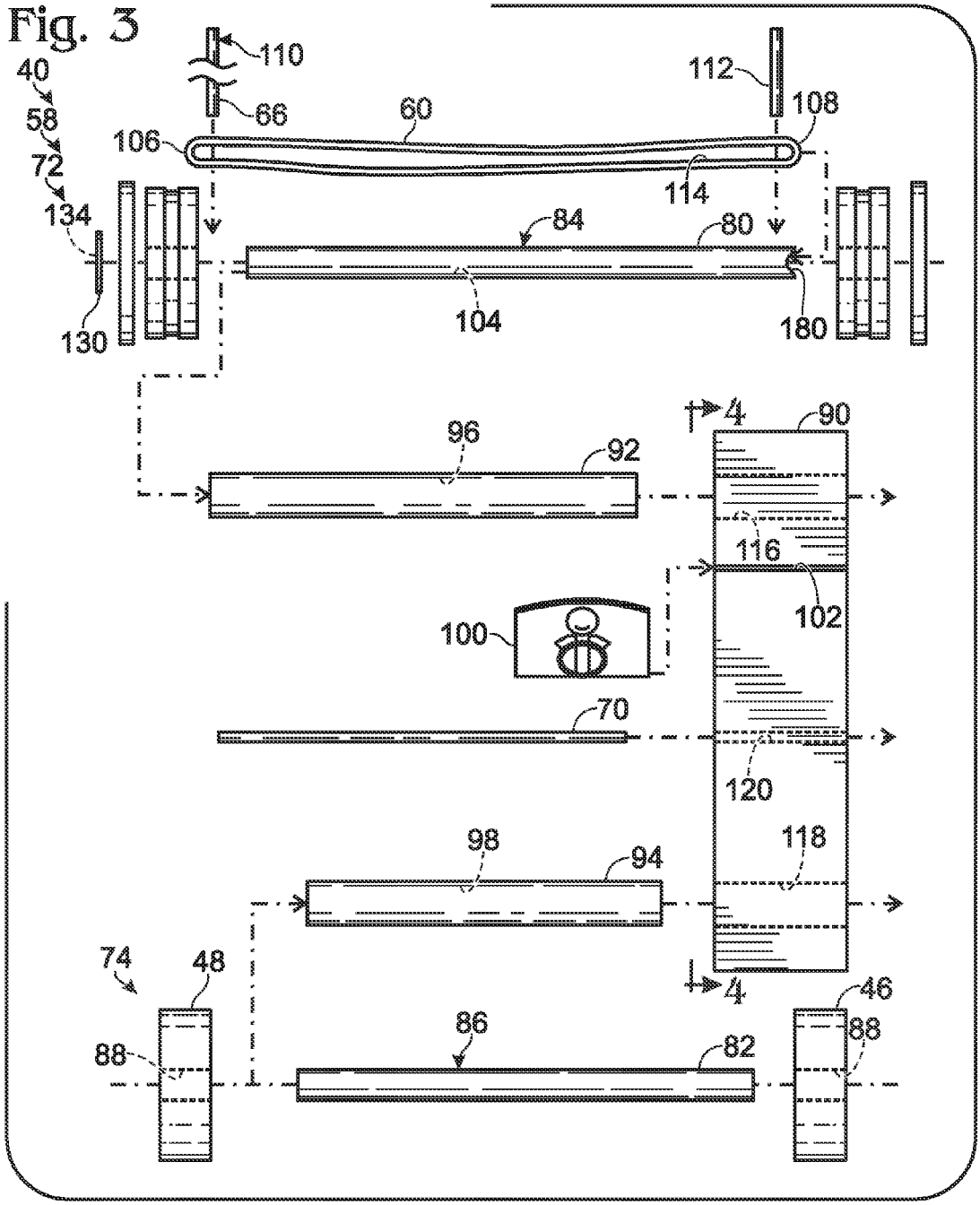
FIG. 3 is an exploded plan view of the toy vehicle of FIG. 1.

FIGS. 2 and 3 show respective top and exploded views of vehicle 40. Any combination or combinations of the wheels may be incorporated into one or more wheel assemblies. For example, the depicted embodiment has a rear wheel assembly 72 and a front wheel assembly 74, with each wheel assembly configured to rotate as a unit with respect to body 42 about a respective axis of rotation 76, 78. Axes 76 and 78 may be parallel to each other, and axis of rotation 76 may be substantially coaxial to winding axis 62.

Each wheel assembly may include at least one wheel or a pair of wheels and an axle 80, 82 fixed to the wheel(s), such that the axle and wheel operate as a unit. The axle may extend from one wheel to another wheel of the wheel assembly. Each axle may be provided by a respective tube 84, 86 (see FIG. 3), which may be described as a smaller tube or an axle tube.

The axle tube may be discrete from the wheels, which permits each component to be optimized independently. For example, the length and inner diameter of each axle tube can be altered to allow for different sizes of the spring. Also, in different versions of the vehicle, wheels of different materials and sizes can be assembled with the same axle tube to optimize speed, distance, and/or power. In other embodiments, the wheel assembly may include one or more wheels and an axle that are continuous with one another, i.e., formed by the same piece of material.

Attachment of the axle tube to each wheel may be via a fastener, mechanical coupling, friction, an adhesive, or any combination thereof, among others. For example, in the depicted embodiment, each wheel defines a central bore 88 (see wheels 48 and 50 of FIG. 3), and opposing ends of tube 84 or 86 are placed into (and, optionally, through) the bore to form a hub. Each tube may (or may not) remain open at both ends. The wall of the wheel's bore may engage the outer surface of the axle tube to fix the wheel to the axle tube by friction, while the wheel remains removable from the axle tube if disassembly and/or repair is necessary or desired.

The tubes and wheels may be formed of any suitable materials. In some cases, the tubes may be formed of a polymer material (i.e., plastic) and the wheels (or at least a body thereof) may be formed of wood. Readily available wood "plugs" may be used for the wheels as they are inexpensive and light, and can be drilled easily. Any other component of the vehicle may be formed of any suitable material, such as plastic, wood, metal, or the like.

Each wheel assembly, and particularly the axle thereof, may be disposed in and may extend through a channel defined by body 42 (see FIGS. 2 and 3). For example, body 42 may be composed of a main portion 90 (e.g., a block of any suitable shape) and a pair of sleeves 92, 94 connected to the main portion. Sleeves 92, 94 may be described as larger or holding tubes (as compared to smaller, axle tubes 84, 86). Each sleeve may define a channel 96, 98 in which axle 80 or 82 is disposed. The sleeve may function as a bushing to reduce friction between the axle and the body. Accordingly, the sleeve may be formed of plastic. Also, the inner diameter of the sleeve is greater than the outer diameter of the axle, to permit the axle to spin freely in the sleeve. Furthermore, the length of each sleeve is generally less than the length of the corresponding axle measured from wheel to wheel, to avoid friction between the end of the sleeve and the wheel as the wheel spins. Contact and friction between the sleeve and the axle in the sleeve can be reduced by decreasing the area of contact (e.g., shortening the sleeve). Each sleeve may project laterally any suitable distance from opposing lateral surfaces of main portion 90 of the vehicle's body.

Body 42 may be decorated or accessorized. For example, main portion 90 may be attached to a card 100 bearing a representation of a driver and/or one or more vehicle components, among others. The card may be received in a slot 102 defined by main portion 90 (also see FIG. 4).

Spring 60 may be disposed in a wheel assembly, such as rear wheel assembly 72 (see FIG. 3). For example, the spring may be disposed in tube 84 (or 86), such that the spring extends along, and optionally through, a channel 104 defined by the tube. Opposing ends 106, 108 of the spring may be held at opposing ends of the wheel assembly (and/or tube) by respective fasteners, such as pins 110, 112. Ends 106, 108 of the spring may be disposed outside of the respective, adjacent wheel hubs.

Each of pins 110 and 112 also or alternatively may be described as a stick and/or a rod, among others. Pin 110 may provide arm 66. The pins may (or may not) be of different length, with long pin 110 being longer than short pin 112. For example, long pin 110 may be longer than the radius and/or diameter of the wheel, and short pin 112 may be longer than the diameter of tube 84 and shorter than the radius and/or diameter of the wheel. Any of the pins, rods, and/or sticks disclosed herein may be formed of any suitable material, such as wood, plastic, metal, etc. Also, each pin, rod, and/or stick may have any suitable cross-sectional shape such as circular, rectangular, oval, or the like.

Each pin may prevent an associated end of the spring from being pulled into the axle, particularly when the spring is tensioned by twisting. The pin may extend through an opening 114 formed by the spring, such that the end wraps partway around pin. The spring may be formed of an elastomeric material, such as synthetic or natural rubber, and may be provided as a rubber band that forms a closed loop. Accordingly, each pin may extend through the closed loop at opposing ends thereof.

End 106 of the spring may be a pivotable end that is permitted to spin with respect to the wheel assembly about winding axis 62 (also see FIGS. 1 and 2). Accordingly, pivotable end 106 may be coupled to long pin 110 such that both pivot together (or remain fixed together). In other words, pivotable end 106 (and long pin 110/arm 66) may be capable of spinning while wheel assembly 72 is held fixed (e.g., grasped by hand). Also, wheel assembly 72 may be capable of spinning while pivotable end 106 is held fixed (e.g., via engagement of arm 66 of long pin 110 with stop 68 or by contact of the arm with a horizontal play surface).

End 108 of the spring may be a fixed end that is held fixed with respect to the rear wheel assembly. Fixed end 108 may be coupled to short pin 112 such that both spin (or don't spin) in synchrony with the rear wheel assembly.

Figure 4:
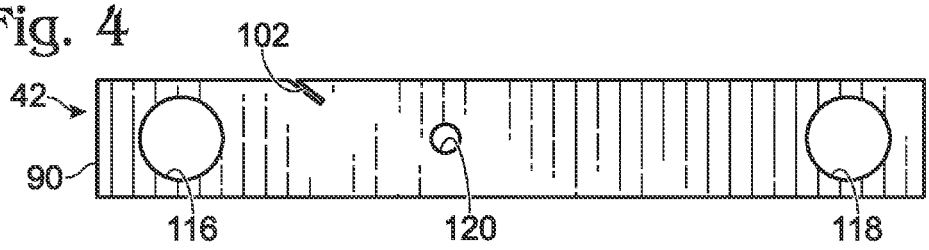
FIG. 4 is a side view of a portion of the toy vehicle's body, taken generally along line 4-4 of FIG. 3.

FIG. 4 shows a side view of main portion 90 of body 42. The main portion may define a plurality of transverse bores 116-120. Sleeves 92, 94 (see FIG. 3) may be placed through bores 116, 118, respectively, and may be held in place by friction, fasteners, adhesive, etc. Rod 70 may be received in bore 120, which may be sized to permit the rod to slide axially between deployed and retracted configurations (or may be size to prevent the rod from sliding).

Figure 5:
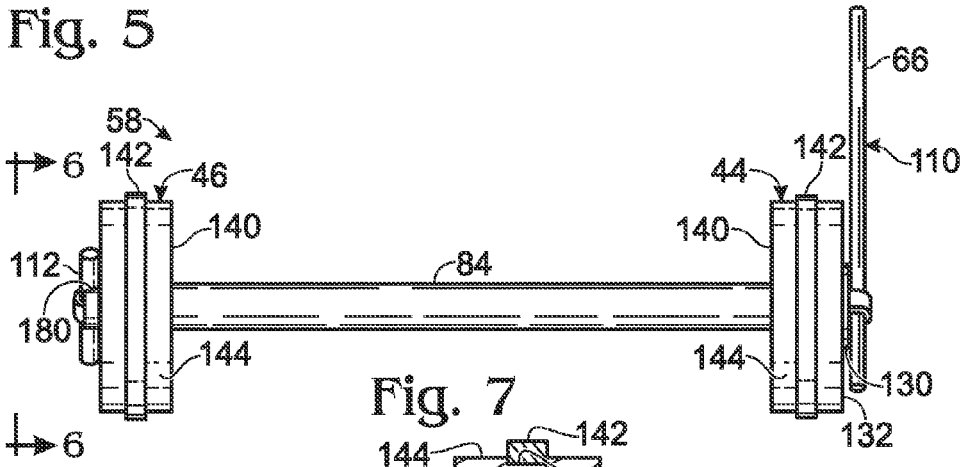
FIG. 5 is a view of the drive train of the toy vehicle of FIG. 1, taken in isolation from other vehicle components.

FIG. 5 shows drive train 58 of vehicle 40 assembled in isolation from other vehicle components. Long pin 110 may be separated from wheel 44 by at least one lubricious coating or element 130 (also see FIGS. 1 and 3), which may be described as a spacer element. The element (or coating) may be configured to increase lubricity (i.e., reduce friction) and reduce wheel-pin contact, compared to absence of the element or coating, when wheel assembly 72 and the long pin are spinning relative to each other. The element or coating thus generally has a lower coefficient of friction than an outer face 132 of wheel 44. The element may define an aperture 134 for receiving pivotable end 106 of spring 60 (see FIG. 3). Aperture 134 may have a diameter that is smaller than the inner diameter of tube 84, and/or at least large enough to receive spring 60 without binding. In exemplary embodiments, element 130 is a bushing, which may be described as a washer, composed of a low friction material, such as a low-friction plastic (e.g., polyethylene or polyvinylchloride, among others). In some cases, element 130 may be cut or punched from a smooth, low-friction sheet of material (e.g., a card). In some cases, element 130 is integral to the wheel rather than being a separate component.

Figure 6:
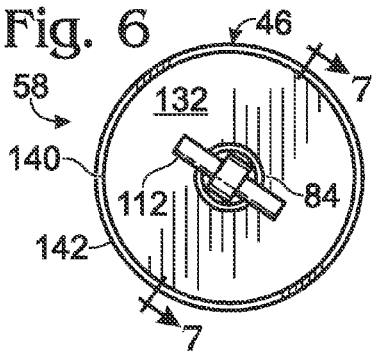
FIG. 6 is an end view of the drive train of FIG. 5, taken generally along line 6-6 of FIG. 5.
Figure 7:
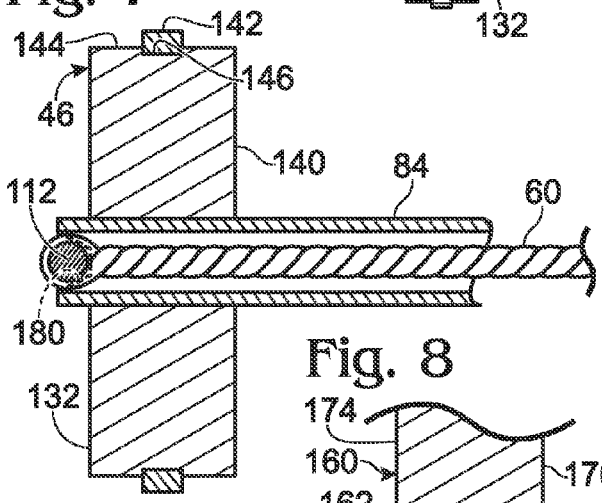
FIG. 7 is a fragmentary sectional view of the drive train of FIG. 5, taken generally along line 7-7 of FIG. 6.

FIGS. 6 and 7 show respective end and fragmentary sectional views of drive train 58. Each rear (and/or front) wheel (e.g., wheels 44 and 46) may be composed of a wheel body, such as a disk 140 (or other circular body), and at least one traction element 142, which may be termed a tire. The traction element may extend around the wheel body, such as extending around and/or adjacent a rolling surface 144 of the wheel body. The traction element may increase the ability of the wheel to grip a play surface and thus may increase friction with the play surface relative to the wheel body alone. Disk 140 may include one or more grooves 146 formed in rolling surface 144 and sized to receive the traction element(s). The traction element may, for example, be formed of an elastomeric and/or resilient material that permits the element to be stretched to fit around the wheel body, for placement into groove 146. In exemplary embodiments, the traction element is an elastomeric band with a thickness greater than the depth of the groove, such that the traction element projects above rolling surface 144 to provide contact with the play surface. The band also or alternatively may have a width that is less than the width of the groove. In any event, the side walls of the groove may restrict lateral slippage of the band.

Figure 8:
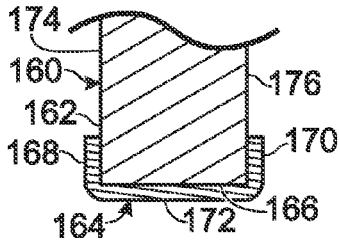
FIG. 8 is a fragmentary sectional view of an alternative embodiment of a wheel for the vehicle of FIG. 1, taken generally as in FIG. 7.

FIG. 8 shows an alternative embodiment of a wheel 160 for a toy vehicle. The wheel may include a wheel body 162 and a traction element or tire 164 covering a rolling surface 166 of the wheel body. The traction element may be equipped with opposing flanges 168, 170 to hold the traction element on the wheel body, by resisting lateral movement of the traction element relative to wheel body. The flanges project radially inward from a ground-contacting portion 172 of the traction element, to positions adjacent outer and inner faces 174, 176 of the disk. Traction element 164 may be composed of any suitable material, including any of the materials described above for traction element 142.

FIGS. 6 and 7 illustrate how short pin 112 may be fixed in position with respect to wheel 46. Tube 84 may project past outer face 132 of the wheel and may define one or more notches 180 at one of its ends to receive short pin 112 and restrict its pivotal movement. (One of notches 180 is visible in FIG. 3.) Alternatively, or in addition, one or more notches may be formed in the outer face of the wheel. In any event, tension provided by spring 60, before and/or after twisting the spring, may urge and hold short pin 112 in the notches, to prevent rotation of pin 112 (about winding axis 62) relative to the wheel assembly. Tube 84 may, for example, be provides as a plastic tube (such as a drinking straw), making the tube stiff, light, resilient, and inexpensive, although other materials could be utilized. Also, because drinking straws (or similar tubes) are easily cut with scissors and readily available in many lengths and diameters, this simple design can be altered in many ways.

II. EXAMPLES

The following examples describe selected aspects and embodiments of the present disclosure, including exemplary windup and release modes for the toy vehicle and other exemplary stops for arm engagement. These examples are intended for illustration and should not limit the entire scope of the present disclosure.

Example 1

Exemplary Windup Modes

Figure 9:
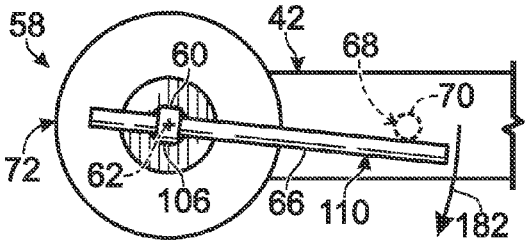
FIG. 9 is a fragmentary side view of the toy vehicle of FIG. 1, illustrating an exemplary approach for winding the spring of the drive train by spinning the arm of the drive train while a wheel assembly of the drive train is held fixed, in accordance with aspects of the present disclosure.
Figure 10:
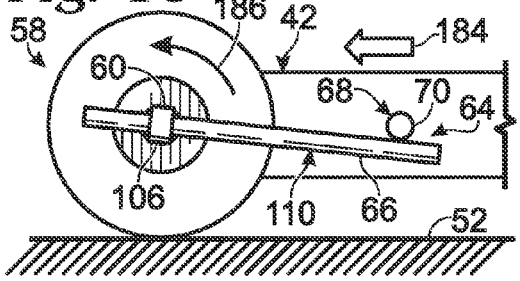
FIG. 10 is a fragmentary side view of the toy vehicle of FIG. 1, taken generally as in FIG. 9, but with the stop engaged with the arm of the drive train as in FIG. 1, and illustrating an exemplary approach for winding the spring of the drive train by rolling the wheel assembly in reverse along a play surface while the arm is engaged with the stop, in accordance with aspects of present disclosure.

This example describes exemplary windup modes for the toy vehicles disclosed herein; see FIGS. 9 and 10.

FIG. 9 illustrates an exemplary approach for winding spring 60 of drive train 58. Rod 70 may be placed in a retracted configuration (e.g., see FIG. 2), indicated in dashed outline, to position stop 68 clear of the spinning path for arm 66. Wheel assembly 72 may be held fixed with respect to body 42. For example, one of the rear wheels may be grasped by hand. Pin 110 (and thus arm 66) then may be spun about winding axis 62, such as by engaging arm 66 with an index finger and moving the finger in a repetitive circular motion about axis 62. The arm (and coupled spring end 106) may be spun, indicated by an arrow at 182, any suitable number of revolutions, to place any suitable number of twists in the spring, according to the strength and elasticity of the spring and the available space in the axle tube for accommodating higher order (e.g., secondary and tertiary) twists in the spring. In some embodiments, a tube in which the spring is disposed may have an inner diameter that is at least about 10, 15, 20, 25, or 50 percent greater than the total of the combined measurements of the width and/or width plus thickness of the spring that is to be twisted, when the spring is in the tube and ready to be twisted. In some embodiments, the spring may be capable of being twisted at least about 25 or 50 times by spinning the arm, without breaking the spring or causing it to bind.

FIG. 10 illustrates another exemplary approach for winding spring 60 of drive train 58. Rod 70 may be placed an extended, deployed configuration (e.g., see FIG. 1), to position stop 68 in the spinning path of arm 66, which blocks the arm from spinning. The vehicle's wheels then may be engaged with play surface 52, and the vehicle manually driven backwards, indicated at 184, which rolls, indicated at 186, the wheels of rear wheel assembly backwards along the play surface. Since clutch assembly 64 is engaged (i.e., rod 70 is engaged with long pin 110), arm 66 and pivotable end 106 of spring 60 are held fixed with respect to body 42, while the other end of the spring spins with the wheel assembly. As a result, one full twist is introduced into spring 60 for each revolution of the wheel assembly. If desired, a relatively short stretch of play surface may be swept repeatedly with the vehicle to increment the number of twists in the spring with each backward sweep. At the end of each backward sweep of the vehicle, a rear wheel can be grasped, to prevent the spring from untwisting, while the vehicle is lifted from the play surface, moved forward, and positioned for another backward sweep on the play surface.

Example 2

Exemplary Release Modes

Figure 11:
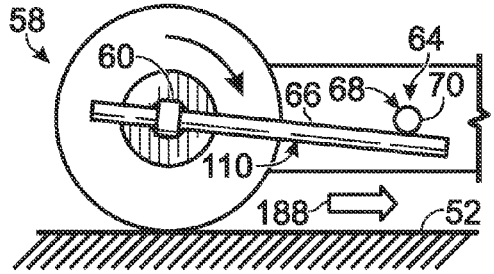
FIG. 11 is a fragmentary side view of the toy vehicle of FIG. 1, taken as in FIG. 10, and illustrating forward travel of the toy vehicle on a play surface while the arm is engaged with the stop, in accordance with aspects of present disclosure.
Figure 12:
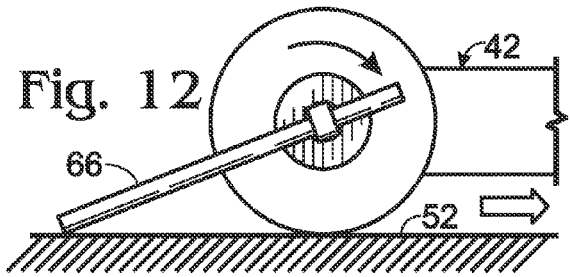
FIG. 12 is a fragmentary side view of the toy vehicle of FIG. 1, taken generally as in FIG. 9 but with the arm engaged with a play surface, and illustrating forward travel of the toy vehicle on the play surface while the arm is dragged along the play surface, in accordance with aspects of present disclosure.

This example describes exemplary release (and/or travel) modes for the toy vehicles disclosed herein; see FIGS. 11 and 12.

FIG. 11 illustrates forward travel, indicated at 188, of the toy vehicle on play surface 52. Clutch assembly 64 may be in an engaged configuration in which stop 68 blocks arm 66 from spinning. Spring 60 urges arm 66 against rod 70 as the vehicle is traveling forward. In other words, the arm is kept out of contact with play surface 52, which prevents the arm from acting as a brake or rudder by dragging along the play surface. The travel configuration depicted here may be achieved after winding spring 60 using the approach of either FIG. 9 or 10. From the retracted configuration of FIG. 9, a user may slide the rod into the deployed configuration of FIG. 11, while the rear wheels are prevented from spinning, before or after positioning the vehicle on the play surface, and then may release the vehicle. If utilizing the windup mode of FIG. 10, a user simply may release the vehicle after the final backward sweep on the play surface.

FIG. 12 illustrates forward travel of the toy vehicle with arm 66 dragged along play surface 52, instead of supported by body 42 of the vehicle. Arm 66 is prevented from spinning by contact with the play surface. The arm extends generally rearward, away from the direction of vehicle travel. However, the arm may act as a brake and/or rudder to reduce the speed of the vehicle and urge the vehicle off a straight course.

Example 3

Exemplary Stops

Figure 13:
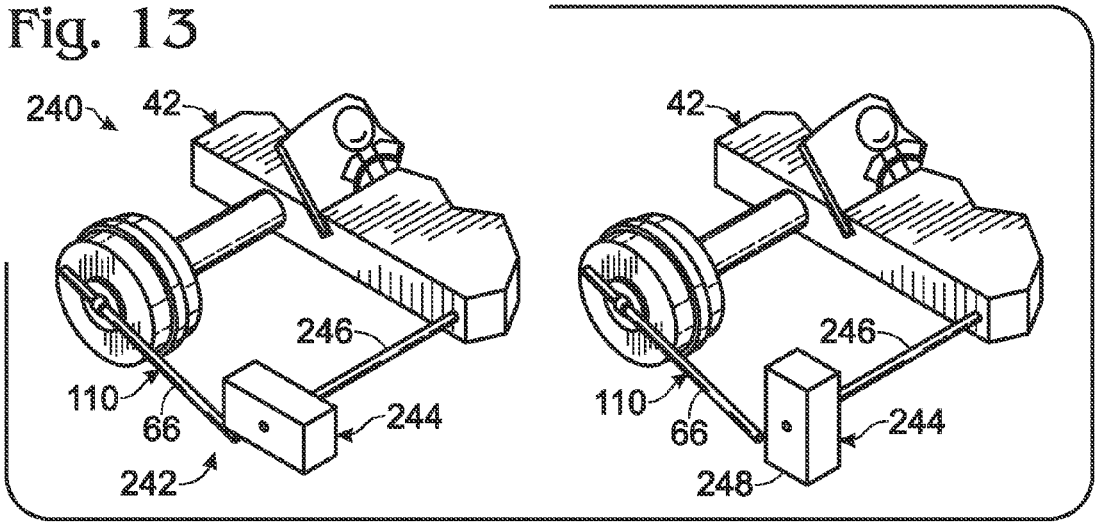
FIG. 13 is a pair of views of another exemplary toy vehicle constructed according to aspects of the present disclosure, and illustrating another exemplary stop that is movable between configurations that prevent (the view on the left) or permit (the view on the right) spinning of the arm.
Figure 14:
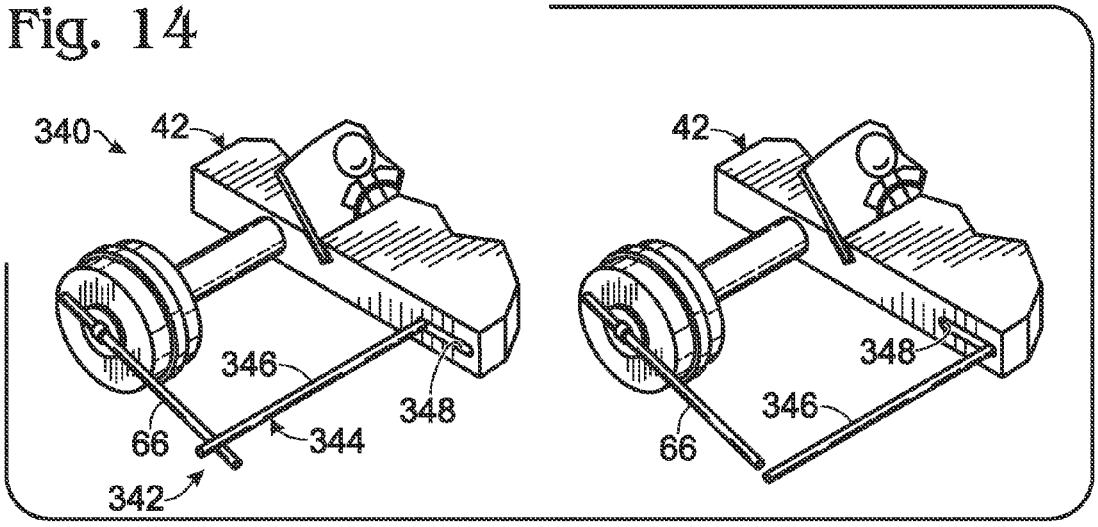
FIG. 14 is a pair of views of yet another exemplary toy vehicle constructed according to aspects of the present disclosure, and illustrating another exemplary stop that is movable between configurations that prevent (the view on the left) or permit (the view on the right) spinning of the arm.
Figure 15:
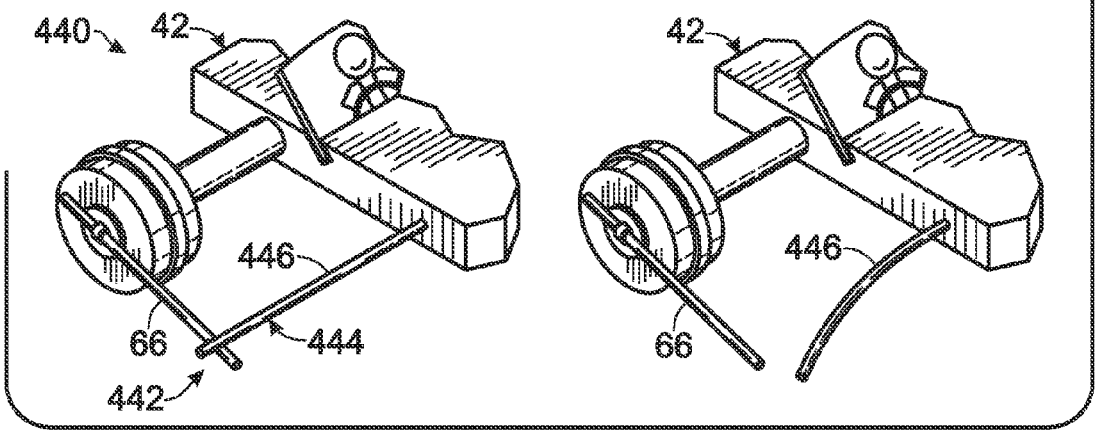
FIG. 15 is a pair of views of still another exemplary toy vehicle constructed according to aspects of the present disclosure, and illustrating another exemplary stop that is movable between configurations that prevent (the view on the left) or permit (the view on the right) spinning of the arm.

This example describes exemplary stops and stop/arm configurations for the toy vehicles disclosed herein; see FIGS. 13-15.

FIG. 13 shows a pair of views of another exemplary toy vehicle 240 with another exemplary embodiment of a clutch assembly 242 formed by arm 66 and a stop 244. The stop may be structured as a turn key that is pivotable with respect to body 42 between an engaged configuration (on the left) and a disengaged configuration (on the right). An engaged configuration, here and in FIGS. 14 and 15, may be used to wind up the toy vehicle (e.g., as described for FIG. 10) and/or to drive travel of the vehicle on a play surface when wound up and released. A disengaged configuration, here and in FIGS. 14 and 15, may, for example, be used to wind up the toy vehicle in the manner described for FIG. 9 or to permit driven travel in the manner described for FIG. 12.

Stop 244 may include a stem or rod 246 and a head 248 that are connected to each other fixedly or pivotably. If fixed to each other, stem 246 may be pivotably connected to body 42 for pivotal motion about the long axis of the stem. In any event, the head may be pivotable with respect to body 42 to move the head between the engaged and disengaged configurations, which respectively block and permit spinning of the arm. In other examples, the length of arm 66 may be adjusted by sliding long pin 110 axially (i.e., along the long axis of the pin), to switch between disengaged and engaged configurations of the clutch assembly. Accordingly, the stop may be fixed with respect to the vehicle body.

FIG. 14 shows a pair of views of still another exemplary toy vehicle 340 with another exemplary embodiment of a clutch assembly 342 formed by arm 66 and a stop 344. The stop may be structured as a rod 346 that is movable in a direction transverse to the long axis of the rod, such as at least generally rearward and forward along body 42, to provide respective engaged and disengaged configurations of the clutch assembly (or vice versa). Body 42 may define a slot 348 that receives the rod and which is elongated at least generally in the direction of travel of the vehicle.

FIG. 15 shows a pair of views of yet another exemplary toy vehicle 440 with another exemplary embodiment of a clutch assembly 442 formed by arm 66 and a stop 444. The stop may be structured as a rod 446 that is bendable in a direction transverse to the long axis of the rod, such as at least generally rearward or forward along the body, to provide an engaged or disengaged configuration of the clutch assembly. Rod 446 may be flexible (as shown here) or may have pivotably connected to the vehicle's body.

Example 4

Selected Embodiments

This example presents selected embodiments of the present disclosure as a series of numbered paragraphs.

1. An apparatus for propelling a vehicle, comprising: (a) first and second wheels removably attached to either end of a hollow tube such that these three parts become fixed relative to one another during operation in a wheel-tube assembly (b) said wheel-tube assembly having a tube that is open at both ends and that is accessible from the outside face of both wheels, (c) said first and second wheels being made from light, resilient material like wood or plastic, (d) a spring element made of an elastomeric material such as rubber or a man-made polymer, (e) said hollow tube having an inside diameter that is at least 15 percent greater than the total of the combined measurements of the width plus thickness of the spring element that is to be twisted, when the spring element is in the tube and ready to be twisted, (f) said spring element being strung through the center of the wheel-tube assembly such that either end of the spring element extends past the outside edge of the hub of the adjacent wheel, (g) the first end of said spring element being removably attached to a short, first rod on the outside face of the hub of the wheel directly adjacent to it, (h) said first, short rod securely attached to the wheel-tube assembly such that it cannot move relative to the wheel-tube assembly during operation, (i) the second end of said spring element being removably attached to a second, longer rod resting across the outside face of the wheel hub directly adjacent, (j) said second rod being engaged with said wheel-tube assembly such that the assembly can spin relative to said second rod, (k) a fixed point on the body of a vehicle designed to engage the second, longer rod, (l) wherein said body is designed to engage the tube of the wheel assembly in a way that allows for the wheel-tube assembly to spin freely, or (m) any combination of (a) through (l).

2. The apparatus of paragraph 1, wherein said hollow tube is made from a plastic drinking straw.

3. The apparatus of paragraph 2, wherein said straw is ¼ inch or more in outside diameter.

4. The apparatus of paragraph 2, wherein said straw is 2 to 8 inches in length.

5. The apparatus of paragraph 1, wherein the elastomeric material is a rubber band.

6. The apparatus of paragraph 5, wherein the rubber band is of a standard industry size.

7. The apparatus of paragraph 5, wherein the rubber band is a number 30, 31, 32, 33, 62, or 64.

8. The apparatus of paragraph 1, wherein one or more bushings are placed between the second, longer rod and the face of the adjacent wheel in order to reduce the contact and friction between rod and spinning wheel.

9. The apparatus of paragraph 8, wherein the bushing(s) are made of separate, thin, smooth, sheet plastic like PVC or polyethylene.

10. The apparatus of paragraph 8, wherein the bushing(s) are integral to the wheel.

11. The apparatus of paragraph 1, wherein the hollow tube extends past the outside face of the hub of said first wheel.

12. The apparatus of paragraph 11, wherein a portion of the tube that extends past the outside face of the adjacent wheel hub has notches cut into it for receiving and securing the first, short rod during operation.

14. The apparatus of paragraph 1, wherein the first rod is removably attached to the wheel-tube assembly.

15. The apparatus of paragraph 1, wherein the first rod is integral to the hub of the adjacent wheel.

16. The apparatus of paragraph 1, wherein the first, short rod is secured directly to the adjacent wheel.

17. The apparatus of paragraph 1, wherein the wheel-tube assembly is held together with friction between the tube and a hole in each wheel.

18. The apparatus of paragraph 1, wherein the wheel-tube assembly is held together by mechanical forces or chemical bonds common in glue or other adhesives.

19. The apparatus of paragraph 1, wherein one or more of the wheels are improved with one or more channels in their rolling surface(s) to accept one or more rubber bands that can act as tires.

20. The apparatus of paragraph 19, wherein the channels are designed to accept other types of tires that improve the frictional contact between vehicle and playing surface without increasing rolling resistance significantly.

21. The apparatus of paragraph 1, wherein the wheel assembly defines a channel extending along the axis of rotation, wherein the channel has opposing ends, and wherein each of the opposing ends is open.

22. The apparatus of paragraph 1, wherein each wheel defines a central through-hole, and wherein the tube extends into the central through-hole of each wheel and is fixed to such wheel by frictional engagement with a wall of the through-hole.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements. Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

We claim:

1. A toy vehicle, comprising:

a body;

a wheel assembly connected to the body and defining an axis about which the wheel assembly spins;

a spring extending at least generally along the axis and having a first end and a second end that are respectively fixed and pivotable with respect to the wheel assembly;

an arm coupled to the spring at the second end such that the arm and the second end pivot as a unit, the arm being disposed adjacent and extending substantially parallel to an outer face of a wheel of the wheel assembly, the wheel having a radius, and the arm extending from the axis farther than the radius; and a stop supported by the body and configured to block the arm from spinning with respect to the body, wherein the spring is twistable, and wherein untwisting of the spring, with the arm blocked from spinning by the stop, drives the wheel assembly to spin with respect to the body, and wherein the stop is movably supported by the body for movement of the stop between a first position that permits the arm to spin with respect to the body and a second position that contacts the arm to prevent the arm from spinning with respect to the body.

2. The toy vehicle of claim 1, wherein the body includes a main portion and a tube connected to the main portion, and wherein the wheel assembly extends through the tube.

3. The toy vehicle of claim 1, wherein the wheel assembly includes at least one wheel and a tube fixed to the wheel, wherein the tube forms an axle of the wheel assembly, and wherein the spring extends through the tube.

4. The toy vehicle of claim 3, wherein the wheel assembly includes a pair of wheels, wherein the tube is fixed to each of the wheels, and wherein the tube and each wheel are discrete from one another.

5. The toy vehicle of claim 1, wherein the spring is an elastomeric band that forms a closed loop.

6. The toy vehicle of claim 1, further comprising a lubricious element disposed between the arm and the face of the wheel and configured to reduce friction when the arm spins with respect to the wheel.

7. The toy vehicle of claim 1, wherein the spring defines an opening, and wherein the arm extends through the opening.

8. The toy vehicle of claim 1, wherein the axis is a first axis, further comprising at least one other wheel connected to the body and configured to spin about a second axis that is spaced from the first axis.

9. The toy vehicle of claim 1, wherein the body defines a transverse channel, and wherein the stop includes a rod disposed in the transverse channel.

10. A toy vehicle, comprising:

a body;

a wheel assembly connected to the body and defining an axis about which the wheel assembly spins;

a spring extending at least generally along the axis and having a first end and a second end that are respectively fixed and pivotable with respect to the wheel assembly; and a clutch assembly adjustable between a first configuration that couples rotation of the second end of the spring to rotation of the wheel assembly and a second configuration that uncouples rotation of the second end from rotation of the wheel assembly, wherein the clutch assembly includes an arm coupled to the spring at the second end such that the arm and the second end pivot as a unit, the arm being arranged radially adjacent an outer side of a wheel of the wheel assembly and extending beyond a circumferential perimeter of the wheel, wherein the clutch assembly also includes a stop that engages the arm in the first configuration, and wherein the stop is slidable parallel to the axis to adjust the clutch assembly between the first configuration and the second configuration.

11. The toy vehicle of claim 10, further comprising a lubricious element or coating disposed on an outer face of a wheel of the wheel assembly and configured to reduce friction.

12. A toy vehicle, comprising:

a body;

a wheel assembly connected to the body and defining an axis about which the wheel assembly spins;

at least one wheel connected to the body, forward or rearward of the wheel assembly, such that the wheel and the wheel assembly collectively support the body during vehicle travel;

a spring extending at least generally along the axis and having a first end and a second end that are respectively fixed and pivotable with respect to the wheel assembly;

an arm coupled to the spring at the second end such that the arm and the second end pivot as a unit, the arm being arranged radially adjacent an outer side of a wheel of the wheel assembly and extending beyond a circumferential perimeter of the wheel; and a stop movably supported by the body for movement of the stop between a first position that permits the arm to spin with respect to the body and a second position that contacts the arm to prevent the arm from spinning with respect to the body, wherein the spring is twistable by rotating the arm about the axis, and wherein untwisting of the spring, with the arm blocked from spinning, drives the wheel assembly to spin with respect to the body.

13. The toy vehicle of claim 12, wherein the wheel assembly is a first wheel assembly, and wherein the at least one wheel includes a pair of wheels included in a second wheel assembly.

14. The toy vehicle of claim 12, wherein the wheel assembly includes a pair of wheels and a tube secured to each of the wheels and forming an axle between the wheels.

* * * * *